US006523666B2

(12) United States Patent
Winkler

(10) Patent No.: US 6,523,666 B2
(45) Date of Patent: Feb. 25, 2003

(54) UNDERNEATH VIEW PANELING FOR ESCALATORS AND MOVING WALKWAYS

(75) Inventor: Gerald Winkler, Neusiedl/See (AT)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/812,369

(22) Filed: Mar. 20, 2001

(65) Prior Publication Data

US 2001/0025763 A1 Oct. 4, 2001

(30) Foreign Application Priority Data

Mar. 31, 2000 (EP) ..... 00810269

(51) Int. Cl.[7] ..... B66B 23/00; B66B 23/12
(52) U.S. Cl. ..... 198/321; 198/325; 198/333
(58) Field of Search ..... 198/321–338

(56) References Cited

U.S. PATENT DOCUMENTS 4,175,653 A * 11/1979 Kubota et al. ..... 198/332
4,535,880 A * 8/1985 Boltrek ..... 198/330
4,627,527 A * 12/1986 Saito ..... 198/335
4,681,207 A * 7/1987 Goto et al. ..... 198/333
4,842,122 A * 6/1989 Van Nort ..... 198/335
5,029,690 A * 7/1991 Nguyen et al. ..... 198/335
5,295,568 A * 3/1994 Saito et al. ..... 198/330
5,628,391 A * 5/1997 Volkening et al. ..... 198/325
6,129,198 A * 10/2000 Nusime ..... 198/326

OTHER PUBLICATIONS

Patent Abstracts of Japan, Pub No. 11236182, Aug. 8, 1999. "Outer Facing Body For Slope Moving Device".
Patent Abstracts of Japan, Pub. No. 10101283, Apr. 21, 1998. "Exterior Facing Device of Passenger Conveyor".

* cited by examiner

*Primary Examiner*—Douglas Hess
(74) *Attorney, Agent, or Firm*—Schweitzer Cornman Gross & Bondell LLP

(57) ABSTRACT

Underneath view paneling for an escalator or moving walkway has a respective bent-over portion at each of its lateral edges and is screw-connected at the bent-over portions to fastening blocks. The fastening blocks are in turn screw-connected to profile members connected to the escalator/moving walkway framework. The fastening blocks have an elongate hole for each fastening screw, allowing compensation for construction tolerances to be achieved. The fastening block screws are preferably screwed into a clamping plate disposed behind elongate holes of the profile member. The clamping plates are preferably parallelogram-shaped and are so constructed such that in one orientation they can pass through the elongate holes of the profile member, while when turned through about 90° to a second orientation they cannot pass through the elongate holes. Side paneling for the escalator can be fastened to the underneath view paneling by means of clamping springs.

7 Claims, 3 Drawing Sheets

UNDERNEATH VIEW PANELING FOR ESCALATORS AND MOVING WALKWAYS

The present invention relates to an escalator or a moving walkway with a framework and an underneath view paneling, and to an underneath view paneling for an escalator or a moving walkway.

BACKGROUND OF THE INVENTION

Underneath view paneling and side paneling are commonly utilized in escalators and moving walkways. Within the scope of maintenance operations, occasional access to the covered parts of the escalator or moving walkway is necessary, requiring the removal of such covering panels. Since the tolerances of many subassemblies that are used coincide and thus accumulate in the regions at which the panelings are mounted, measures have to be undertaken to allow the panels to be mounted in a manner which compensates for the tolerances.

In the past there were two possibilities for compensating for tolerances, either by individually matching the dimensions of the underneath view paneling to the size of the particular framework, or by concealing the tolerances and spacings generated thereby by means of trimming strips between the side paneling and underneath view paneling. Both solutions are relatively expensive.

It is an object of the present invention to provide an underneath view paneling mounting system in which the tolerances of the framework can be compensated for, while allowing the underneath view panelings to be mounted with respect to each other without gaps or unwanted spaces. A further object of the present invention is to provide such a mounting system wherein no mounting screws are visible from the outside of the escalator.

BRIEF DESCRIPTION OF THE INVENTION

The foregoing and other objects are met in the case of an escalator or moving walkway of the stated type in that the underneath view paneling has a respective bent-over portion at each of its lateral edges. The underneath view paneling is screw-connected at the bent-over portions to fastening blocks; the fastening blocks are connected to the framework. Adjustment means are provided for the fastening blocks which allow them to be connected to framework in a manner which provides walkway compensation for tolerances. Since the underneath view paneling is laterally screw-connected at the bent-over portions to the fastening blocks, the screws can be covered by side paneling so that they are not visible from the outside. The fastening blocks are connected, directly or indirectly, to the framework, the adjustment means allowing their exact position to be changed to a certain degree before they are fixed in place. In this manner compensation can be provided for the tolerances of the framework and prefabricated underneath view paneling can be employed.

In a preferred embodiment the fastening blocks are screw-connected to profile members mounted on the framework, wherein the fastening blocks have, at least at one side of the escalator or moving walkway, an elongated hole for each fastening screw. The longitudinal direction of the elongated hole extends transversely to the escalator or moving walkway. Thus, compensation is provided for tolerances in the transverse direction, as each fastening block can be displaced in the longitudinal direction of the elongate hole through which the fastening screw penetrates. If the underneath view paneling is connected to the fastening blocks by self-tapping screws, tolerances in longitudinal direction are less critical.

The profile members can be U-section profile members welded by the limbs thereof either to the framework or to an underneath view plate connected to the framework. The profile members can also be C-section profile members, screw-connected by the bases thereof to the framework or to an underneath view plate connected to the framework. This latter embodiment possibility is advantageous in retrofitting situations.

It is also possible for the fastening blocks to compensate for tolerances in a longitudinal direction In a further embodiment of the present invention the fastening screws for the fastening blocks are screwed into a clamping plate disposed behind a slot of the C-section profile member or behind elongate hole of the U-section profile member wherein the clamping plates are so constructed that in one orientation they can pass through the slot of the C-section profile member or through the elongate hole of the U-section profile member. In a second orientation, they can be turned through at most about 90° when in the profile member, such that they cannot pass through the slot of the C-section profile member or through the elongate hole of the U-section profile member, and are thus retained by the profile member. Compensation for tolerances in the longitudinal direction is thus achieved, in that the entire unit consisting of fastening block, screw and clamping plate can be displaced as required within the slot of the C-section profile member or in the elongate hole of the U-section profile member.

Assembly of the unit is carried out by bringing the unit up to the profile member in such a manner that the clamping plate passes through the slot or hole of the profile member. The fastening screw is then turned to rotate the clamping plate through about 90° until it abuts the walls of the profile member. Thereafter, the fastening screw is further screwed into the clamping plate until the fastening block—previously moved into the correct position—is firmly clamped in place. A suitable shape for the clamping plate is a parallelogram With this shape the desired characteristics can be easily and reliably achieved, allowing the plate to be inserted in one orientation into the hole of a slot and to be turned through at most about 90° when inserted in the profile member to a position where it cannot then pass through the hole or slot.

It is advantageous if clamping springs for side paneling are mounted to the bent-over portions of the underneath view paneling. When the side paneling is fastened in this manner to the underneath view paneling, any gap between these two paneling is excluded. In this sense an underneath view paneling in accordance with the invention for an escalator or a moving walkway may be characterized by a bent-over portion at both sides with clamping springs mounted at the bent-over portions.

BRIEF DESCRIPTION OF THE DRAWINGS

The present invention is more fully explained in the following description of illustrative embodiments in conjunction with the accompanying figures, in which.

DETAILED DESCRIPTION OF THE INVENTION

Figure 1:
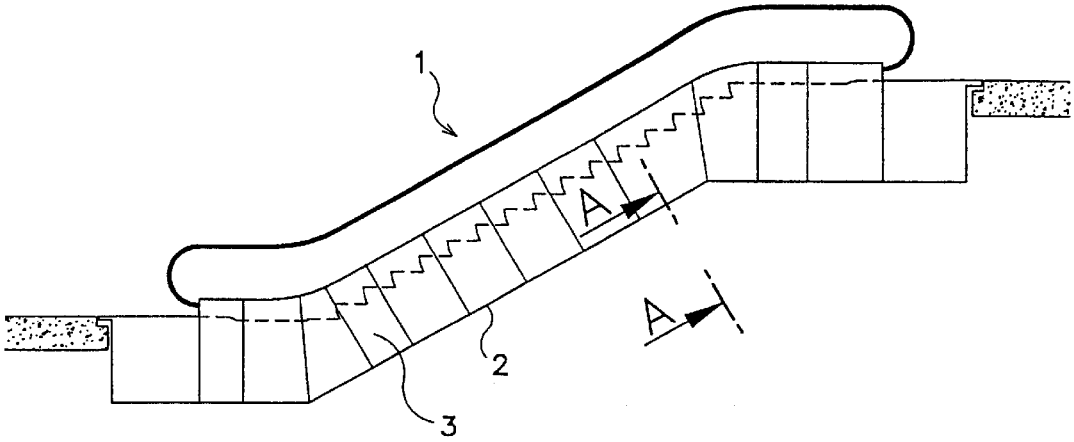
FIG. 1 is a side view of an escalator according to the invention.
Figure 2:
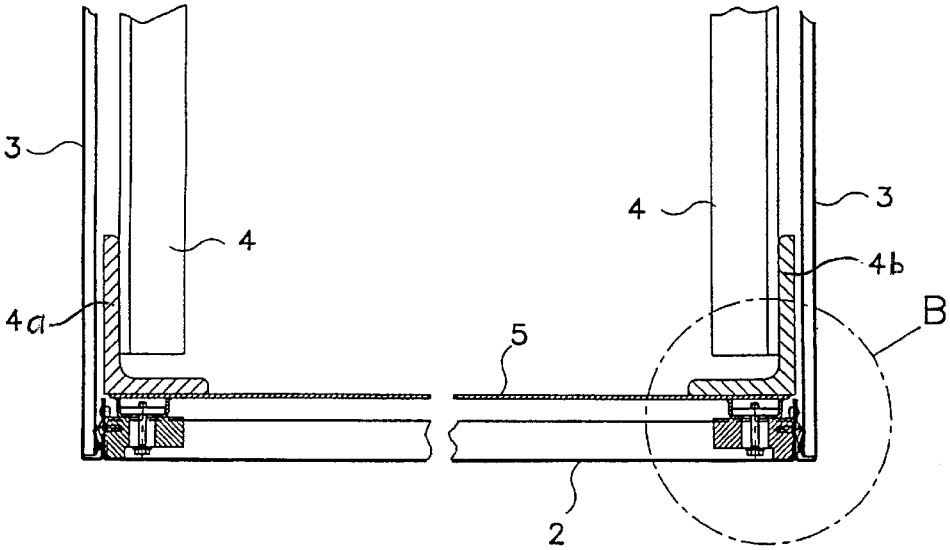
FIG. 2 is a section view in elevation taken along line A—A in FIG. 1.
Figure 3:
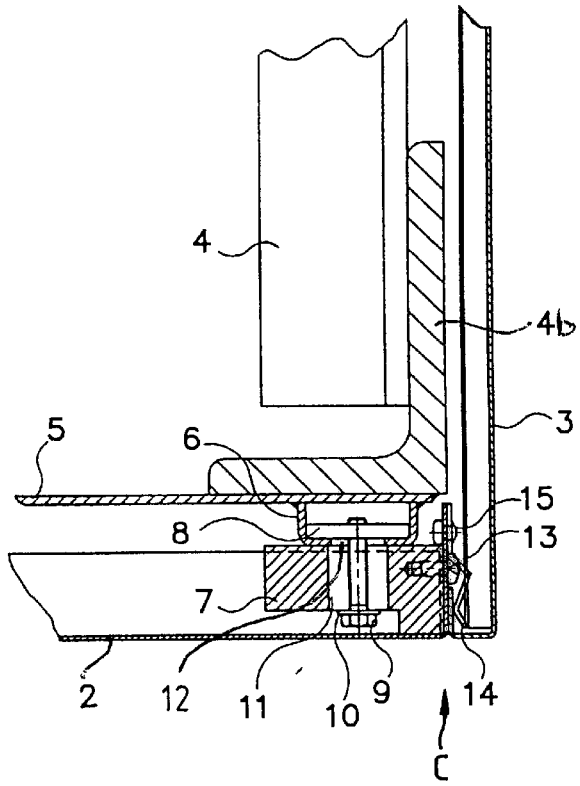
FIG. 3 is an enlarged view of region B of FIG. 2.
Figure 4:
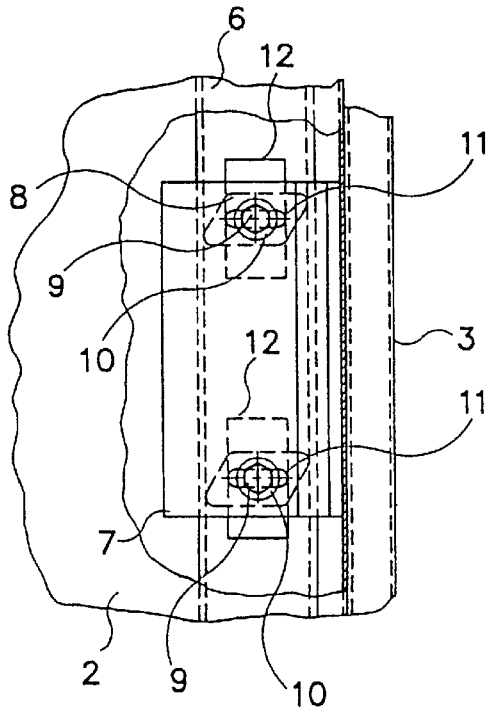
FIG. 4 is a bottom plan view of the area referenced by arrow C in FIG. 3.

With initial reference to FIG. 1, the escalator 1 has side paneling 3 and underneath view paneling 2. The fastening of the underneath view paneling in accordance with the invention is described with reference to FIGS. 2 to 4. An underneath view plate 5 is welded to the escalator framework 4 (see FIG. 2) by framework angle irons 4*a*, 4*b*. Two U-section profile member 6 (see FIGS. 3 and 4) are fastened to the underneath view plate 5 at its right and left sides by welding. The underneath view plate 5 can, however, also be omitted; the U-section profile members 6 are then directly welded to the framework angle irons 4*a*, 4*b*. The U-section profile member 6 has two elongate holes 12 (see FIG. 4) for each fastening block 7. The fastening block 7 itself has two elongate holes 11 (see also FIG. 3), through each of which is inserted a respective fastening bolt or screw 9. Each fastening bolt 9 is provided with a lock washer 10 and is screwed into a clamping plate 8 disposed in the U-section profile member 6. When the fastening screw 9 is loose, the fastening block 7 can be displaced in the longitudinal direction of the escalator 1 (upwardly and downwardly as seen in FIG. 4) due to the elongate holes 12, and in the transverse direction of the escalator 1 (to the left and right, as seen in FIG. 4) by virtue of the elongate holes 11. The fastening block 7 is fixed in a correct, adjusted position by tightening the fastening bolts 9.

As can be seen in FIG. 4, the clamping plate 8 may be in the form of a parallelogram The length and width of this parallelogram are somewhat smaller than the length and the width of the elongate holes 12, so that the clamping plate 8 can pass through the elongate holes 12 when aligned therewith. The major diagonal of the parallelogram is, however, longer than the internal width of the U-section profile member 6, so that the clamping plate 8 can be turned in the U-section profile member 6 only through about 90° after it has been inserted through the elongate hole 12 into the interior of the U-section profile member 6. In this position diagonal corners of the clamping plate abut against the limbs of the U-section profile member 6, as illustrated in FIG. 4.

The underneath view paneling 2 is screw-connected to the correctly adjusted fastening blocks 7. The underneath view paneling 2 has bent-over portions at its two sides. The screws 13, by which the underneath view paneling 2 is screw-connected, penetrate the bent-over portions. The screws 13 are thus disposed at the paneling sides and are not visible from below. Moreover, clamping springs 14 are fastened to the bent-over portions by means of rivets 15. The side paneling 3 is fastened to the underneath view paneling and fastening blocks 7 by the clamping springs. The side paneling 3 thus covers the screws 13 and the clamping springs 14 so that they are not visible from the side.

Assembly of the paneling takes place in the following manner: Two fastening screws or bolts 9 with lock washers 10 and clamping plates 8 are pre-mounted in each fastening block 7. The two clamping plates 8 are aligned parallel to the elongate holes 12 in the profile member and the fastening block 7 is brought approximately into its intended position, the clamping plates 8 now lie in the elongate holes 12. The clamping plates 8 then are put into the position shown in FIGS. 3 and 4 by pressing in the fastening screws 9 and applying a slight rotation in the clockwise sense in the figures, displacing the clamping plates from their alignment with the elongate holes 12. The fastening block 7 is then brought as precisely as possible into its intended position and the fastening screws 9 are fully tightened. After all fastening blocks 7 have been brought into position, the underneath view paneling 2 is mounted by its bent-over portions upon the fastening blocks 7 and is screw-connected thereto by means of the screws 13. In a preferred form, the assembly is carried out with threaded self-tapping screws or furrowing screws. Finally, the side paneling 3 is then fastened to the underneath view paneling 2 by means of the clamping springs.

Figure 5:
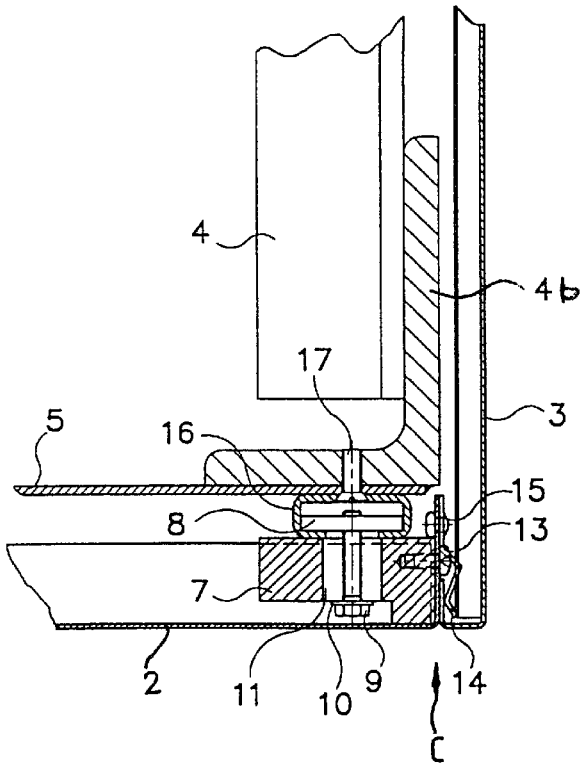
FIG. 5 is a view, analogous to FIG. 3, of an alternative embodiment.
Figure 6:
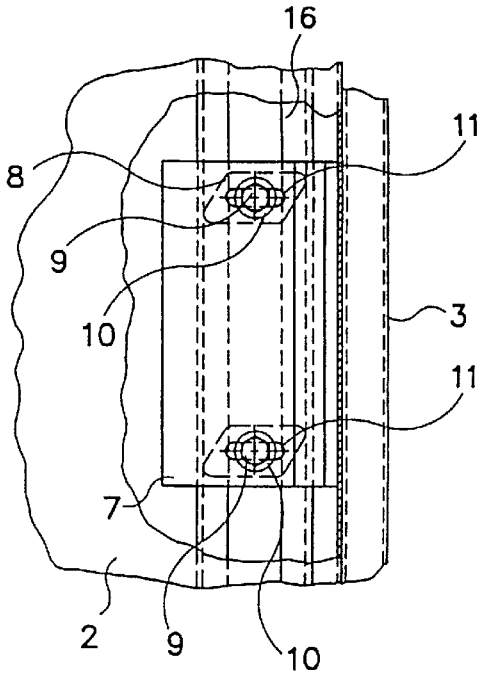
FIG. 6 is a view bottom plan view of the area referenced by arrow C in FIG. 5.

The modified embodiment according to FIGS. 5 and 6 differs in that a C-section profile member 16 is provided instead of the welded U-section profile member 6. This C-section profile member 16 is screw-connected at the base thereof to the framework angle irons 4*b* by screws 17. The slot of the C-section profile member 16 replaces the elongate holes 12 of the U-section profile member 6. The fastening blocks 7 can therefore be fastened at any desired place along the length of the profile member 16 extending in the longitudinal direction of the escalator.

The elements of the underneath view paneling can include different materials, such as painted or powder-coated sheet steel, stainless steel, or aluminum

I claim:

1. An escalator or moving walkway having a framework, underneath view paneling having a pair of lateral edges each having a respective bent-over portion, the bent-over portions being mounted to fastening blocks connected to the framework, and adjustment means associated with the fastening blocks at at least one lateral edge of the underneath view paneling.

2. The escalator or moving walkway according to claim 1, characterized in that the fastening blocks are screw-connected by fastening screws to profile members mounted to the framework, said adjustment means comprising an elongate hole in the fastening block for each fastening screw.

3. The escalator or moving walkway according to claim 2, wherein the profile members are U-section profile members having at least one of said elongate holes and limbs welded to the framework or to an underneath view plate connected to the framework.

4. The escalator or moving walkway according to claim 2, wherein the profile members are C-section profile members having a slot and a base screw-connected to the framework or to an underneath view plate connected to the framework.

5. The escalator or moving walkway according to claim 3 or 4, wherein the fastening screws are each screwed into a clamping plate disposed behind the slot of the C-section profile member or behind an elongate hole of the U-section profile member, the clamping plate being constructed such that in one orientation it can pass through the slot of the C-section profile member or through the elongate hole of the U-section profile member and that in a second, turned orientation of about 90° profile member it cannot pass through the slot or elongate hole.

6. The escalator or moving walkway according to claim 5, wherein the clamping plate is in the general shape of a parallelogram.

7. The escalator or moving walkway according to one of claims 1 to 4, wherein clamping springs for side paneling are mounted to the bent-over portions of the underneath view paneling.

* * * * *